US010143258B2

(12) United States Patent
Salmini et al.

(10) Patent No.: US 10,143,258 B2
(45) Date of Patent: Dec. 4, 2018

(54) PROTECTIVE HELMET

(71) Applicant: Anomaly Action Sports S.r.l., Mestre (VE) (IT)

(72) Inventors: Elena Salmini, Mestre (IT); Carlo Salmini, Mestre (IT); Theodore Sharp Ligety, Mestre (IT); Gianluca Bisol, Mestre (IT)

(73) Assignee: ANOMALY ACTION SPORTS S.R.L., Mestre (VE) (IT)

( * ) Notice: Subject to any disclaimer, the term of this patent is extended or adjusted under 35 U.S.C. 154(b) by 0 days.

(21) Appl. No.: 15/212,540

(22) Filed: Jul. 18, 2016

(65) Prior Publication Data

US 2017/0013907 A1 Jan. 19, 2017

(30) Foreign Application Priority Data

Jul. 17, 2015 (IT) ..... 102015000035687
May 30, 2016 (IT) ..... 102016000055802

(51) Int. Cl.
*A42B 3/12* (2006.01)
*A42B 3/06* (2006.01)
*A42B 3/14* (2006.01)

(52) U.S. Cl.
CPC ..... *A42B 3/127* (2013.01); *A42B 3/064* (2013.01); *A42B 3/14* (2013.01)

(58) Field of Classification Search
CPC ..... A42B 3/064; A42B 3/12; A42B 3/121; A42B 3/063; A42B 3/066; A42B 3/125; A42B 3/14; A42B 3/145; A41D 13/015; A41D 31/005
See application file for complete search history.

(56) References Cited

U.S. PATENT DOCUMENTS

2006/0059606 A1* 3/2006 Ferrara ..... A01N 25/18 2/412
2013/0247284 A1* 9/2013 Hoshizaki ..... A42B 3/12 2/413
2014/0096311 A1* 4/2014 Halldin ..... A42B 3/064 2/411
2014/0109298 A1* 4/2014 Faden ..... A41D 31/005 2/411
2014/0189945 A1* 7/2014 Golnaraghi ..... A42B 3/064 2/455
2016/0150835 A1* 6/2016 Salmini ..... A63B 71/1225 428/134

* cited by examiner

*Primary Examiner* — Bobby Muromoto, Jr.
(74) *Attorney, Agent, or Firm* — Tutunjian & Bitetto, P.C.

(57) ABSTRACT

A protective helmet includes a shell provided with an outer surface and an inner surface, at least one pad adapted, in use, to abut against the head of a user who wears the protective helmet, including at least one first surface and a second surface that are opposite each other, elements for the connection of at least one pad to the shell associated with the at least one first surface, wherein the at least one pad is shaped as a substantially laminar body and includes at least one layer deformable and configured in a manner such to allow the sliding and/or the relative rotation between the at least one first surface and the second surface following a shear stress.

17 Claims, 7 Drawing Sheets

PROTECTIVE HELMET

TECHNICAL FIELD OF THE INVENTION

The present invention regards a protective helmet adapted to reduce the stresses transmitted to the head of a user following an impact.

In particular, the protective helmet according to the present invention is configured for reducing the rotational stresses transmitted to the head of a user following an impact.

STATE OF THE ART

During the course of sport or work activities, in which the head of a person can be subjected to trauma, it is known to use a protective helmet adapted to dissipate the energy released following an impact against the helmet itself.

Currently, severe laws regulate the production of protective helmets in order to ensure the obtainment of safe devices, capable of conferring a high level of protection to a user.

Such laws usually provide for executing impact tests aimed to verify the capacity of the helmet to absorb and resist the energy released during an impact. Some impact tests can provide for the use of an anvil-shaped element or a penetrator driven to move in order to impact against a helmet. In other cases, it is the helmet which is moved against an abutment/obstacle.

As is known, following an impact, the forces acting on a helmet can each be resolved into a linear component and a circumferential/rotational component, perpendicular to each other.

The first causes an action of compression of the helmet against the head of a user, while the second causes a rotational action that tends to rotate the head itself of the user.

Generally, the helmets of conventional type show a high resistance to the stresses that have a predominant linear component.

Recent studies have demonstrated that the circumferential/rotational accelerations acting on the head of a person are of great importance with regard to the health and safety of the latter.

Indeed, the rotational accelerations acting on the head of a person can cause trauma, even considerable, to the brain following its shaking within the braincase.

In order to reduce the effects of the rotational accelerations that act on the head of a user, helmets have been developed that have a mutually movable outer shell and inner shell.

In particular, the outer shell is connected to the inner shell through connecting means adapted to dissipate the energy of the rotational components that act during an impact.

In practice, in the case of an impact in which the rotational component is predominant with respect to the linear component, the outer shell rotates with respect to the inner shell and, hence, with respect to the head of a user to which it is constrained, thus dissipating part of the energy of the circumferential/rotational components released during the impact. In such a manner, the size of the rotational effects transmitted to the head of a user is reduced.

A helmet this configured has a complex structure and is costly to make. Moreover, such helmet has a high thickness with respect to the solutions of conventional type due to the presence of a double shell formed by the inner shell and by the outer shell.

In addition, the presence of at least two shells inevitably involves an increase of weight, which is negatively reflected in the helmet use. Indeed, given the same cranial circumference of a user, the greater the mass of a helmet the greater the overall inertial of the mass associated with the head of the user itself and, consequently, the greater the quantity of energy to be dissipated in case of impact.

The increase of weight of the helmet, in addition, can cause greater fatigue of the musculature of a user, especially in the case of a use of the helmet for a prolonged period.

There is therefore the need to provide a protective helmet capable of effectively reducing the effects of the rotational components acting on the head of a user in case of an impact, in the scope of a simple solution, with limited overall weight, as well as reduced manufacturing costs, and capable of overcoming the above-indicated drawbacks of the solutions of conventional type.

SUMMARY OF THE INVENTION

Therefore, the main object of the present invention is to improve the state of the art relative to a protective helmet for the head of a user.

In the context of such task, one object of the present invention is that of providing a protective helmet able to effectively reduce the rotational/circumferential component of the forces acting on the head of a user following an impact.

Another object of the present invention is to provide a protective helmet capable of reducing the effect of the circumferential component of the forces acting on the head of a user, independent of the direction along which the collision against the protective helmet itself occurs.

A further object of the present invention is to provide a protective helmet capable of reducing the effect of the circumferential component of the forces acting on the head of a user in an impact, in the scope of a solution with limited manufacturing costs and simple to actuate.

Another object of the present invention is to provide a protective helmet capable of reducing the effect of the circumferential component of the forces acting on the head of a user in an impact, in the scope of a solution which, given the same cranial circumference of a user, has a reduced and limited weight with respect to the solutions of conventional type.

According to one aspect of the present invention, a protective helmet is provided according to the present principles.

The present specification refers to preferred and advantageous embodiments of the invention.

BRIEF DESCRIPTION OF THE DRAWINGS

Further characteristics and advantages of the present invention will be clearer from the detailed description of a preferred but not exclusive embodiment of a protective helmet, illustrated as a non-limiting example, in the enclosed drawing tables in which.

DETAILED DESCRIPTION OF THE INVENTION

With reference to the enclosed figures, a protective helmet provided, during use, for protecting the head of a user from collision or impact is overall indicated with reference number 1.

The protective helmet 1 according to the present invention is configured for reducing the effect of the forces F that act, following an impact, on the head of a user who wears such protective helmet 1.

Figure 2:
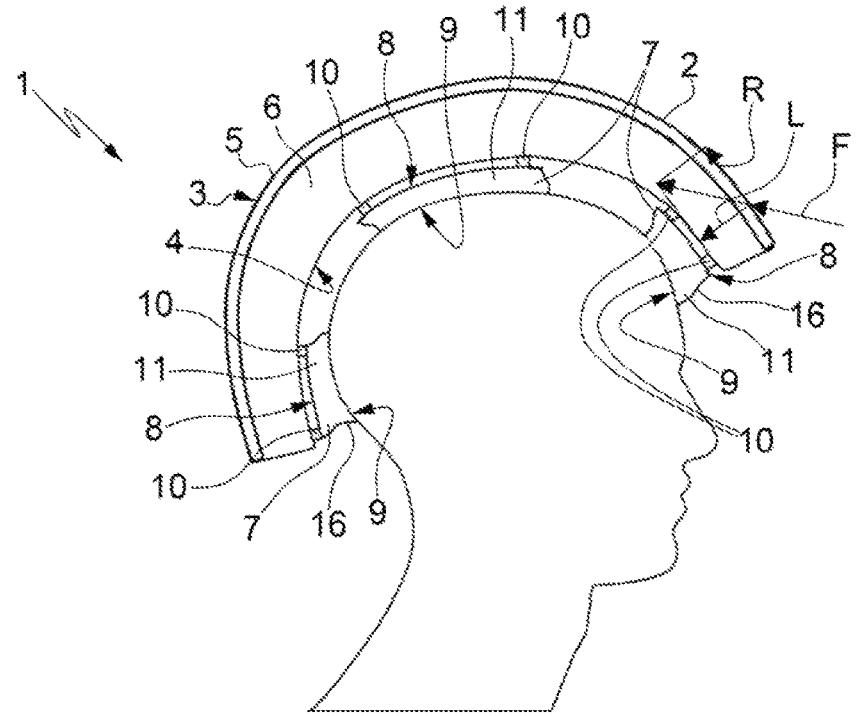
FIG. 2 is a schematic side view in section of a possible configuration of the protective helmet pursuant to FIG. 1 following an impact.
Figure 3:
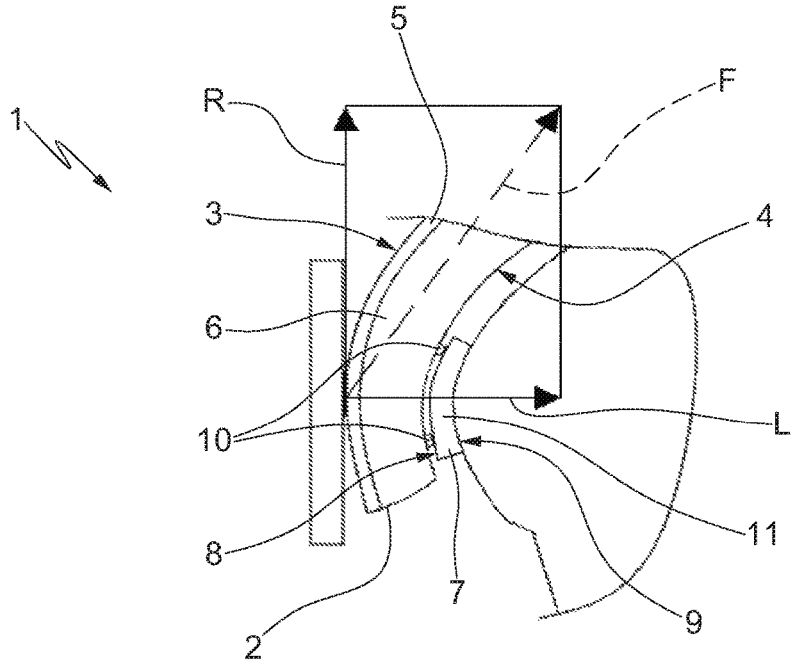
FIG. 3 is an enlarged view of a detail of the protective helmet pursuant to FIG. 1.
Figure 4:
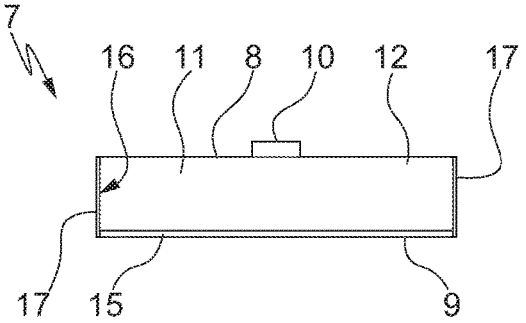
FIGS. 4, 6 and 8 are enlarged views, in side section, of possible configurations of a component of the protective helmet according to the present invention.
Figure 5:
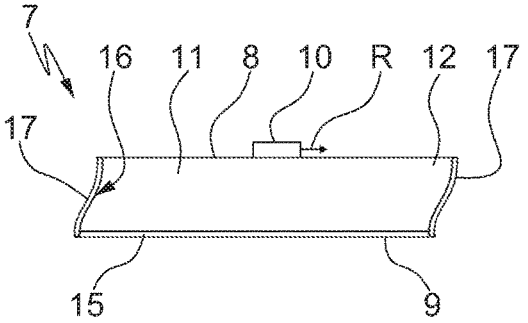
FIGS. 5, 7 and 9 are enlarged views, in side section, of a possible configuration assumed by the component of the protective helmet respectively pursuant to FIGS. 4, 6 and 8.
Figure 6:
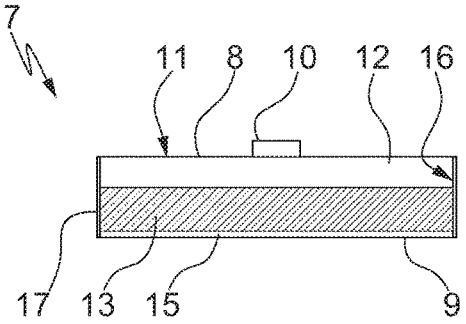
Figure 7:
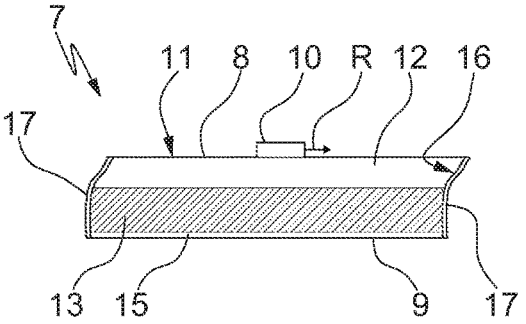

Each of such forces F can be resolved into two components that are orthogonal to each other: a linear force, or linear component, indicated with L and a circumferential/rotational force, or rotational component, indicated with R (FIGS. 2 and 3).

The linear component L is directed outward towards the inside of the protective helmet 1, along a direction substantially orthogonal to the outer surface thereof, while the rotational component R is substantially tangent to the outer surface of the protective helmet 1 and orthogonal to the linear component L.

In particular, the protective helmet 1 according to the present invention, as better described hereinbelow, allows an effective reduction of the effects of the rotational components R acting on the head of a user following an impact.

The protective helmet 1 comprises a shell 2 or cap shaped substantially concave in order to be extended around the head of a user, in order to contain the user's head at its interior.

The protective helmet 1 can be made in different sizes, in order to allow the use by users with different head sizes, thus being usable by adults, children, babies, etcetera.

The shell 2 has an outer surface 3 and an inner surface 4, opposite and separate from each other.

According to one version of the present invention, the shell 2 can comprise at least one outer shell 5.

The shell 2 can also comprise at least one inner padding 6 associated with the outer shell 5.

According to one version of the present invention, the outer shell 5 can have a greater rigidity than that of the inner padding 6, if provided.

The outer shell 5 acts as protective barrier for the impact of an object against the protective helmet 1. The outer shell 5, in fact, is configured for dissipating part of the energy released during the collision and thus reducing the quantity of energy that is then transmitted to the inner padding 6, if present.

It is also observed that the outer shell 5 acts as anti-penetration element in order to prevent an object, in case of impact, from penetrating inside the helmet and injuring the head of a user.

The inner padding 6 can be made of an expanded light material.

For example, it can be made of expanded polystyrene, polypropylene, polyurethane, and other polymers and elastomers, open-cell or closed-cell foams or other materials with high energy absorption, releasable for example in an impact.

According to one version of the present invention, the inner padding 6 can be deformable, elastically and/or plastically, in order to facilitate the dissipation of the forces that are developed following an impact and thus reduce the stresses transmitted to the user's head.

According to a further version of the present invention, the inner padding 6 can be made of a material that has a greater rigidity than that of the material constituting the outer shell 5.

According to a further version of the present invention, at least one between the outer shell 5 or the inner padding 6 can be made of a material with elastic or viscoelastic behavior.

Nevertheless, further versions of the present invention are possible in which the outer shell 5 and the inner padding 6 can be made with the same material or with materials that are different from each other, without any limitation.

By way of a non-limiting example, the shell 2 can be made within a mold in which the outer shell 5 was previously arranged.

For example, a shell 2 comprising both an outer shell 5 and an inner padding 6 can be made through a co-injection process. In such a manner, the outer shell 5 and the inner padding 6 are firmly constrained to each other, substantially forming a single body.

The protective helmet 1 according to the present invention comprises at least one pad 7 associable inside the protective helmet 1 itself.

As will be set forth in the following description, the at least one pad 7 and the shell 2 are mutually associated so as to reduce and dissipate as much energy as possible of the circumferential/rotational R and/or linear L components of the forces F acting on the shell 2 in an impact in order to consequently reduce the accelerations transmitted to the head of a user.

According to one version of the present invention, the at least one pad 7 can have at least one portion that is movable, slidably and/or in rotational manner, with respect to the shell 2 with which it is associated.

According to a further version of the present invention, the at least one pad 7 can be operatively associated with and/or comprise at least one material deformable at least by shearing and thus be movable, slidably and/or rotationally, with respect to the shell 2.

During use, the at least one pad 7 protrudes from the inner surface 4 of the shell 2, towards the inside of the protective helmet 1, on the side opposite the outer surface 3.

In the enclosed figures, the size of the components of the protective helmet 1, with reference, in particular, to the proportions of the at least one pad 7 or the distance of separation of the at least one pad 7 from the inner surface 4 of the shell 2, are accentuated in order to improve the comprehension of the components themselves.

During use, the at least one pad 7 can be configured adherent to the inner surface 4 of the shell 2, and be constrained thereto in a permanent or removable manner.

The at least one pad 7 is shaped substantially laminar.

With the term "laminar" it is intended to indicate that the at least one pad 7 has a limited thickness with respect to the plan extension surface.

The at least one pad 7 has at least one first surface 8 and a second surface 9 that are opposite and spaced from each other.

The at least one pad 7, during use, is associated with the interior of the protective helmet 1 in a manner such that the at least one first surface 8 is proximal to and facing the inner surface 4 of the shell 2, while the second surface 9 is distal from and opposite the inner surface 4 itself.

According to one version of the present invention, the at least one first surface 8 can have a plan extension equal or similar to that of the second surface 9.

According to a further version of the present invention, the at least one first surface 8 can have a plan extension less than that of the second surface 9.

During use, the second surface 9 is provided for firmly abutting against the head of a user.

The protective helmet 1 comprises means 10 for connecting the at least one pad 7 to the shell 2.

More in detail, the connecting means 10 are configured for constraining, at least at one point, the at least one first surface 8 of the at least one pad to the inner surface 4 of the shell 2.

According to one version of the present invention, the connecting means 10 can be configured to allow a connection of removable type between the at least one pad 7 and the shell 2.

For such purpose, the connecting means 10 can be of the type comprising a first element, comparable to a male element and a respective second element, comparable to a corresponding female element, that can be mutually connected in snap or fitted manner or through shape coupling or through any one connection of removable type.

According to such version, the at least one male element can be constrained to the at least one surface 8 and the at least one female element can be constrained along the inner surface 4 of the shell 2, at the portion of the shell 2 where it is intended to associate the at least one pad 7, or vice versa.

Figure 19:
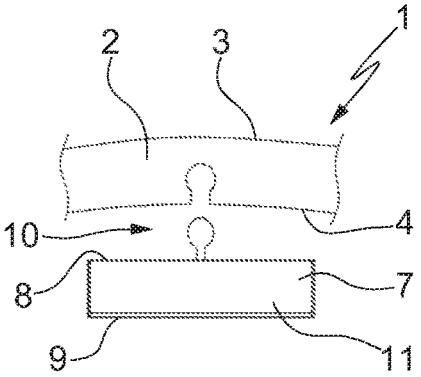
FIG. 19 is a detailed side schematic view of a further embodiment of a protective helmet according to the present invention.

By way of a non-limiting example, the connecting means 10 can comprise automatic buttons in which the male element is substantially mushroom shaped and the female element is shaped as a seat complementary to the male element, adapted to retain it at its interior (see FIG. 19).

It is intended that the shape of the male element and of the respective female element comprised in the connecting means 10, along with the modes for the mutual connection between the at least one surface 8 of the at least one pad 7 and the inner surface 4 of the shell 2, can be different from that described above, e.g. through a mutual reversal of the male and female elements comprised in the connecting means 10, without departing from the protective scope of the present invention.

According to a further version of the present invention, the connecting means 10 can be configured as connecting means of removable type, such as with Velcro® fasteners or similar means adapted for such purpose.

According to a further version of the present invention, the connecting means 10 can be made of at least one fabric layer such as Dacron or the like having on one side an adhesive component and on the opposite side a surface with low friction coefficient.

According to a further version of the present invention, the connecting means 10 can be configured in a manner such to determine a connection of permanent type between the at least one pad 7 and the shell 2.

According to such version, the connecting means 10 can be configured as at least one or more points or portions for anchoring between the at least one pad 7 and the shell 2.

The anchorage between the at least one pad 7 and the shell 2 can be made, for example, through gluing or any one type of connection of chemical/mechanical nature suitable for such purpose.

The connecting means 10 can be associated with the at least one pad 7 in one or more portions thereof, as a function of the shape of the latter and specific use requirements.

Figure 10:
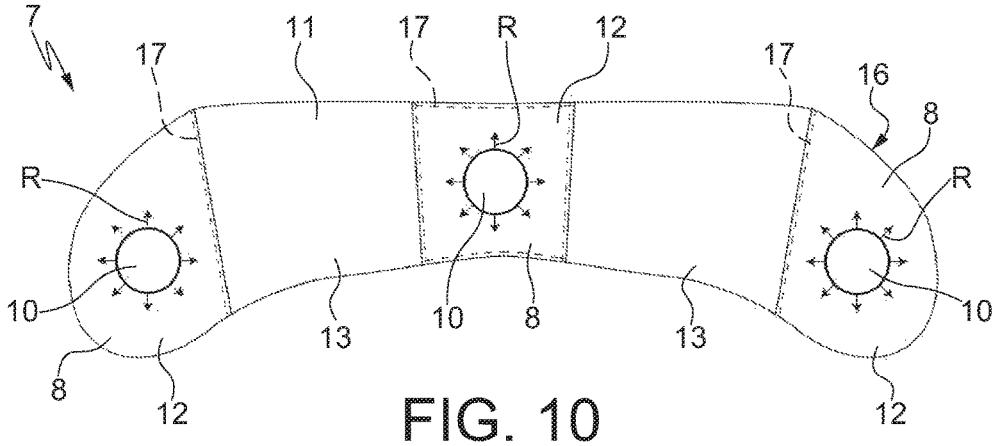
FIGS. 10, 11, 12 and 14 are plan views of several possible configurations of a component of the protective helmet according to the present invention.
Figure 11:
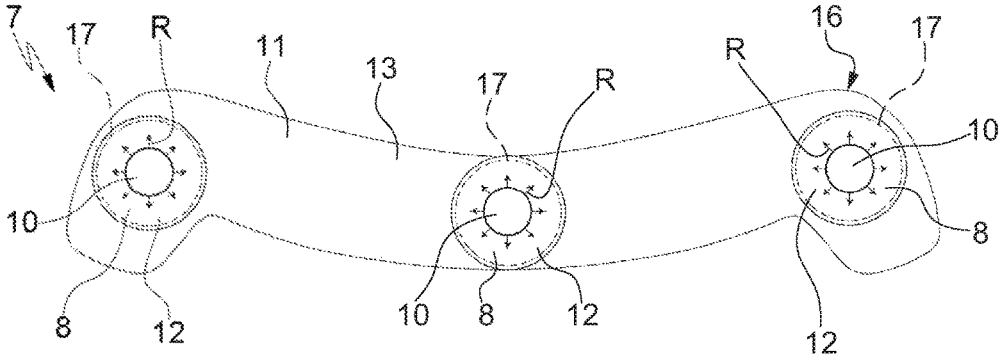

If the at least one pad 7 comprises a plurality of first surfaces 8, each of these can be associated with at least one respective connecting means 10 (FIGS. 10 and 11).

By way of a non-limiting example, with reference to the embodiments illustrated in the enclosed FIGS. 10 and 11, the at least one pad 7 has an elongated shape and comprises three first surfaces 8 and three respective connecting means 10.

Further shapes of the at least one pad 7 are possible, comprising a greater or lesser number of first surfaces 8 and/or of connecting means 10, without departing from the protective scope of the present invention.

Figure 12:
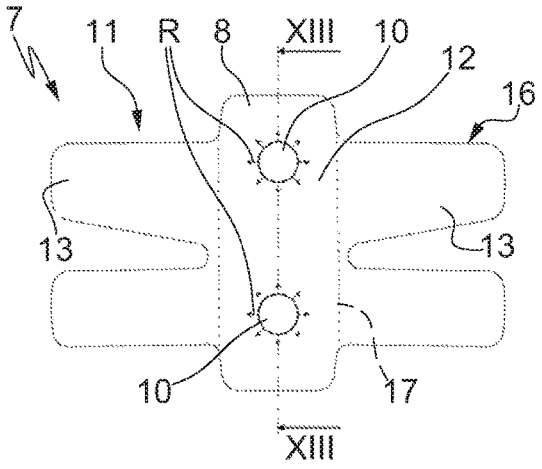

For example, the at least one pad 7 can have a first surface 8 associated with two connecting means 10 (FIG. 12).

It is observed that, during use, the connecting means 10 are interposed between the inner surface 4 of the shell 2 and the at least one first surface 8.

In turn, the at least one pad 7 can act as damping element for the dissipation of the energy released in an impact, in order to reduce, as a much as possible, the stresses that are transmitted to the head of a user, with particular reference to the circumferential/rotational stresses R.

According to one version of the present invention, the at least one pad 7 can comprise at least one layer deformable by shearing, for the purpose of facilitating the movement of the second surface 9 of the at least one pad 7 with respect to the shell 2.

According to such version, the at least one pad 7 is configured in order to facilitate, during use, a shear deformation of at least one portion thereof, rather than a bending deformation.

On such matter, the at least one pad 7 is configured so as to allow a relative movement, through sliding and/or rotation, between the connecting means 10, associated with the at least one first surface 8, and the second surface 9. The circumferential/rotational stresses R transmitted to the at least one pad 7 can cause a shear deformation thereof which in turn can determine a sliding and/or rotation of at least one portion of the at least one first surface 8 with respect to the second surface 9 and vice versa.

The relative movement between at least one portion of the at least one first surface 8 and the second surface 9 can vary as a function of the direction and intensity of the circumferential/rotational components R acting on the at least one pad 7.

In addition, the size of the relative movement between the at least one first surface 8 and the second surface 9 can vary as a function of the material/materials with which the at least one pad 7 is made.

If the at least one pad 7 comprises multiple connecting means 10, the same can be moved independently from each other with respect to the second surface 9, both with regard to the direction and the movement and the amplitude thereof. If the at least one pad 7 is subjected to compression, at least one portion of the at least one first surface 8 can approach at least one portion of the second surface 9 and vice versa.

According to a further version of the present invention, the at least one pad 7 can be elastically or viscoelastically deformable, as better described hereinbelow.

As stated, the at least one pad 7 can be shaped as a laminar body 11 comprising at least one portion made of at least one deformable material, in order to allow the sliding and/or the relative rotation between at least one portion of the at least one first surface 8 and the second surface 9 (FIGS. 4, 5 and 17, 18). In the following description, the term laminar body 11 could be equally used for indicating the at least one pad 7.

According to one version of the present invention, the protective helmet 1 comprises at least one layer 12 deformable by shearing associable with the at least one pad 7, for the purpose of allowing the mobility of the second portion 9 with respect to the shell 2.

According to one version of the present invention, the laminar body 11 can comprise at least one layer 12 deformable by shearing, in a position interposed between the at least one first surface 8 and the second surface 9.

According to one version of the present invention, the at least one layer deformable by shearing 12 can be made of BR, SBS, EVA, PVC or combinations thereof, polyolefins, polyurethanes, elastomers or other similar materials, capable of absorbing mechanical energy, being deformed.

According to a further version of the present invention, the at least one layer deformable by shearing 12 can be in fabric or non-woven fabric form. By way of a non-limiting example, the fabric can comprise polyurethane synthetic fibers adapted to ensure a high elasticity of the fabric itself, e.g. Lycra®, spandex or the like.

According to another embodiment of the present invention, the material of the at least one layer deformable by shearing 12 can be a combination of a fabric and a non-woven fabric.

According to a further embodiment of the present invention, the material of the at least one layer deformable by shearing 12 can be a combination between the previously-indicated materials.

It is intended that the at least one layer deformable by shearing 12 can be associated with the at least one pad 7 according to modes that are different from that described above, though still falling within the protective scope of the present invention.

Following an impact, the forces F acting on the protective helmet 1, and in particular the circumferential components R of such forces F, tend to move the shell 2, rotating it, with respect to the head of a user associated therewith.

In detail, the circumferential components R acting on the shell 2 are transmitted to the at least one pad 7 through the connecting means 10.

Due to such stresses, the at least one layer deformable by shearing 12, of the at least one pad 7, is deformed.

The at least one layer deformable by shearing 12 is configured in a manner such to absorb, during its deformation, as much energy as possible of the circumferential components R acting on the protective helmet 1, thus reducing the rotational accelerations transmitted to the head of a user.

According to a further version of the present invention, the at least one pad 7 can comprise at least one layer deformable by shearing 12 and at least one further layer 13 superimposed on each other (FIGS. 6, 7, 13 and 15).

In fact, according to such version, the at least one layer deformable by shearing 12 and the at least one further layer 13 are connected with each other.

The at least one layer deformable by shearing 12 and the at least one further layer 13 are comprised between the at least one first surface 8 and the second surface 9.

According to one version of the present invention, the at least one layer deformable by shearing 12 and the at least one further layer 13 are mutually constrained through a chemical, mechanical or chemical-mechanical bond suitable for such purpose along at least one portion of the mutual contact surface.

According to a further version of the present invention, the at least one layer deformable by shearing 12 and the at least one further layer 13 are mutually constrained through any one chemical, mechanical or chemical-mechanical bond suitable for such purpose, along an area equal to the entire mutual contact surface. At least one or both between the at least one layer deformable by shearing 12 and the at least one further layer 13 can be made of a deformable material, such as for example an elastically or viscoelastically or plastically or viscoplastically or elastoplastically deformable material, due to a shear stress.

According to one version of the present invention, at least one between the at least one layer deformable by shearing 12 and the at least one further layer 13 can be deformable by shearing, while the other can be more rigid when subjected to shearing and hence poorly deformable if subjected to such stress.

In the enclosed figures, the at least one layer deformable by shearing 12 is represented positioned above the at least one further layer 13. It is intended that the order with which the at least one layer deformable by shearing 12 and the at least one further layer 13 are stacked on each other can be reversed, with respect to that illustrated, while still falling within the present protective scope.

According to one version of the present invention, at least one between the at least one layer deformable by shearing 12 and the at least one further layer 13 can be soft, in order to ensure a good level of comfort to a user.

For example, such soft material can be a low density foam with open or closed cells or an elastomeric material.

With reference to the above-indicated version, it is observed that if the at least one pad 7 comprises at least one layer made of soft material, the latter is during use provided proximal to the head of a user.

By way of a non-limiting example, the at least one further layer 13 is made of the aforesaid soft material.

According to a further version of the present invention, the layer deformable by shearing 12 can be made of polyester fabric, such as a fabric named Dacron®, or the like, which has a high resistance to the shear stresses. In addition, the layer deformable by shearing 12 thus obtained can have on one side a surface with low friction coefficient and on the other opposite side an adhesive layer for allowing the coupling thereof to the shell 2.

Figure 8:
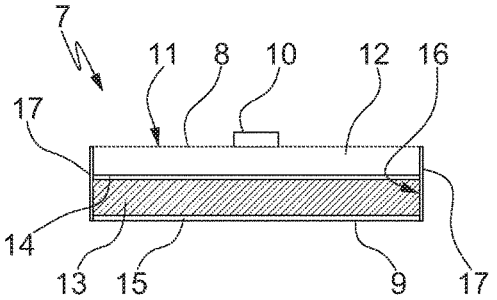
Figure 9:
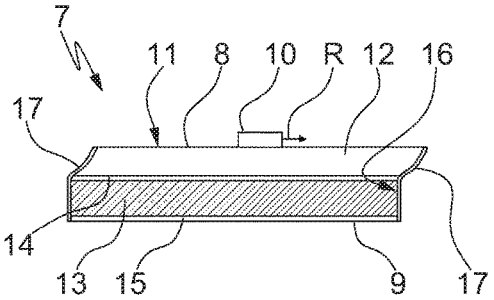

According to a further version of the present invention, the at least one pad 7 can comprise at least one inner layer 14 interposed between the at least one layer deformable by shearing 12 and the at least one further layer 13 (FIGS. 8 and 9).

The at least one inner layer 14 is configured for promoting the relative sliding between the at least one layer deformable by shearing 12 and the at least one further layer 13, thus facilitating the mobility of the at least one pad 7 and preventing jamming which could compromise the effectiveness of the protective helmet 1.

The at least one inner layer 14 can have low friction coefficient.

By way of example, the at least inner layer 14 can comprise PTFE, Nylon, supports coated with permanent lubricant material, nanotechnologies, or the like. In fact, the greater mobility between the at least one layer deformable by shearing 12 and the at least one further layer 13 in turn translates into a greater mobility of the shell 2 with respect to the head of a user who wears the protective helmet 1.

In addition, since the at least one layer deformable by shearing 12 and the at least one further layer 13 are movable from each other due to the at least one inner layer 14, it is actually possible to effectively isolate the head of a user from the rotational stresses acting on the shell 2.

The at least one inner layer 14 therefore acts as a lubricant element, allowing the reduction of the intensity of the rotational stresses R which act on the at least one pad 7, and reducing the effects thereof transmitted to the head of a user.

The at least one pad 7, during use, is provided firmly interposed between the inner surface 4 of the shell 2 and the head of a user.

More in detail, during use, at least one portion of the at least one first surface 8 is associated with the inner surface 4 of the shell 2, while the second surface 9 of the at least one pad 7 is constrained fixed to the head of a user.

During use, in fact, one must prevent relative sliding between the second surface 9 of the at least one pad 7 and the head of a user who wears the protective helmet 1.

Such sliding, in fact, limits the possibility of the at least one pad 7 to be deformed and, consequently, to dissipate the energy associated with the rotational components R.

For such purpose, the at least one pad 7 can possibly comprise, to cover part or all of the second surface 9, an outer layer 15 adapted, during use, to abut against a portion of the head of a user in order to promote a high adherence of the at least one pad 7 against the head itself.

By way of example, the outer layer 15 can comprise a fabric or a soft and yieldable material and provide for the application of a coating with high friction coefficient, adapted to ensure a high adherence as well as a pleasant sense of comfort.

The at least one pad 7 has a lateral surface 16 which delimits the planar perimeter thereof.

With the term "lateral surface" it is intended to indicate the outer surface that is extended along the perimeter edge of the at least one pad 7.

The lateral surface 16 can comprise or not comprise discontinuities, respectively if the at least one pad 7 is made of multiple layers superimposed on each other or of a single layer.

According to one aspect of the present invention, the at least one pad 7 can comprise dissipation means 17 configured for dissipating part of the energy released in an impact, through their deformation.

The dissipation means 17 can be at least associated with the at least one layer 13.

According to a further version of the present invention, if the at least one pad 7 (laminar body 11) comprises at least one layer deformable by shearing 12 and at least one further layer 13, the dissipation means 17 can act as element of connection or constraint between the at least one layer deformable by shearing 12 and the at least one further layer 13.

According to a further version of the present invention, if the at least one pad 7 comprises an inner layer 14 interposed between the layer deformable by shearing 12 and the at least one further layer 13, the dissipation means 17 can act as element of connection or constraint between the inner layer 14 and at least one between the at least one layer deformable by shearing 12 and the further layer 13. It is observed that in other embodiments, not illustrated in the enclosed figures, in which the at least one pad 7 comprises a greater number of layers, the dissipation means 17 can be associated with all or some of the layers that constitute the laminar body 11 without any limitation.

The dissipation means 17 synergistically collaborate with the material/materials constituting the at least one pad 7 in the absorption of the components R, L released in an impact, in order to reduce the effects of the stresses acting on the head of a user.

According to one version of the present invention, the dissipation means 17 can be configured in tape or strip form.

For example, the dissipation means 17 can comprise a fabric or non-woven fabric or stitching or a continuous material such as a glue element or the like. According to a further version of the present invention, the dissipation means 17 can be welding or heat-sealing.

The dissipation means 17 can comprise an elastic, viscoelastic, viscoplastic or elastoplastic material.

If the dissipation means 17 are elastically and/or viscoelastically deformable, if subjected to a stress they can be deformed and resume their original configuration at the moment when such stress ceases.

According to one version of the present invention, the dissipation means 17 can be provided along the at least one pad 7, at at least one portion of the at least one first surface 8.

Preferably, the dissipation means 17 are associated at the area of the at least one first surface 8 in which the connecting means 10 are provided.

In such case, the dissipation means 17 can be configured as a barrier or abutment for the connecting means 10, in order to limit the movement and/or rotation thereof with respect to the second surface 9.

In practice, according to such version, the connecting means 10 can be moved as sliders within one area of the at least one first pad 7 delimited by the dissipation means 17 (FIGS. 10-12 and 14).

The at least one pad 7 can comprise respective dissipation means 17 for each of the connecting means 10 present in the at least one pad 7 itself.

According to one version of the present invention, the dissipation means 17 can be obtained as a single body together with the at least one layer deformable by shearing 12.

According to a further variant, the dissipation means 17 can be obtained as a single body together with the at least one layer deformable by shearing 12 and with the connecting means 10.

Figure 14:
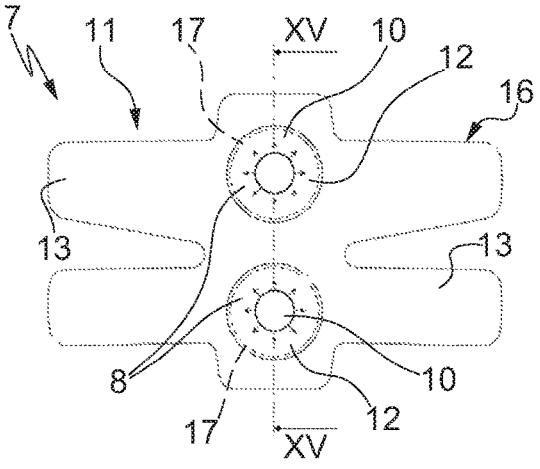
Figure 15:
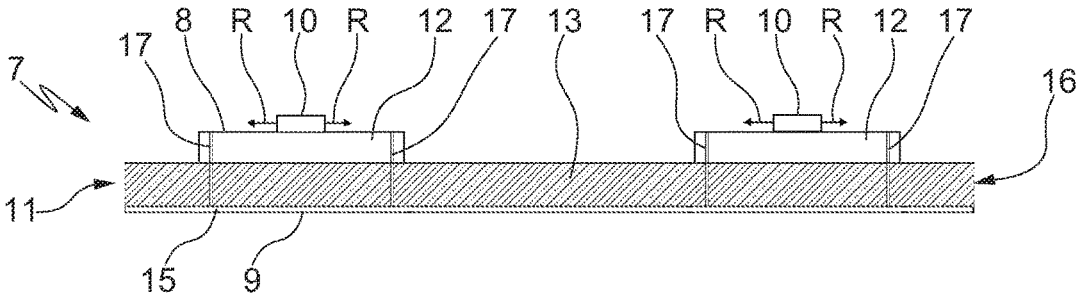
FIG. 15 is a sectional view along the plane XV-XV of the component of a protective helmet pursuant to FIG. 14.
Figure 16:
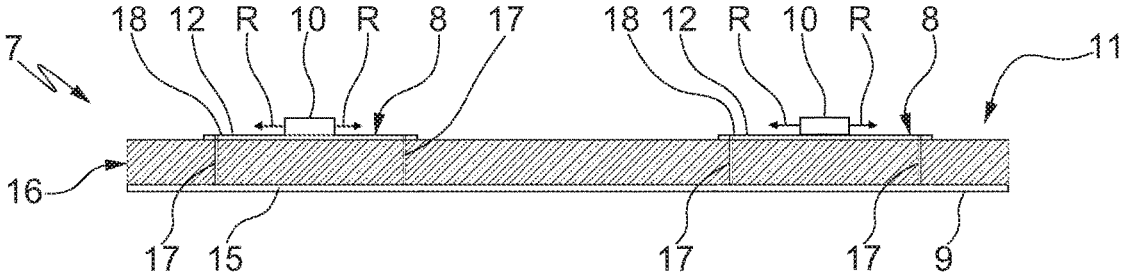
FIG. 16 is a sectional view of a further configuration of the component pursuant to FIG. 15.
Figure 17:
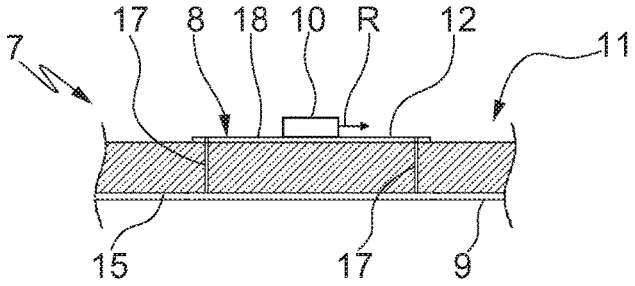
FIGS. 17 and 18 are two side section views of a detail of a component of the protective helmet, respectively in a first and in a second operative configuration.
Figure 18:
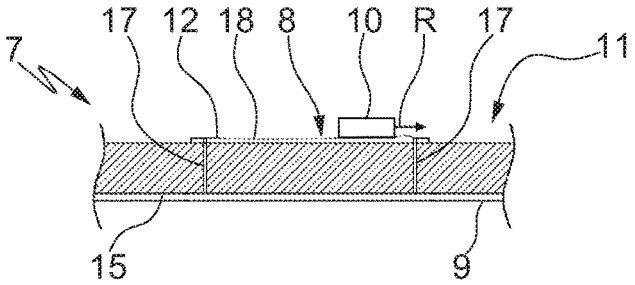

By way of a non-limiting example, the at least one pad 7 illustrated in the enclosed FIGS. 14 and 15 comprises two first surfaces 8, respective connecting means 10 and respective dissipation means 17.

According to one version of the present invention, the dissipation means 17 can be extended at at least one section of the perimeter portion of the at least one pad 7 (FIGS. 10 and 12), along the lateral surface 16.

According to one aspect of the present invention, the at least one layer deformable by shearing 12 can be configured as at least one membrane 18 (FIGS. 14, 16-18).

The membrane 18, analogous to that described above, can be elastic, viscoelastic, viscoplastic or elastoplastic.

In practice, the membrane 18 is configured for dissipating, through its deformation, part of the energy of the rotational components R acting on the shell 2 in an impact.

According to such embodiment, the at least one surface 8 comprised in the at least one pad 7 can have a shape and a planar extension that substantially correspond to those of the at least one membrane 18.

The at least one membrane 18 can be associated with the at least one further layer 13 through the dissipation means 17.

For example, the dissipation means 17 can be arranged along at least one section of the perimeter edge of the at least one membrane 18 itself in order to connect it to the at least one further layer 13.

Figure 13:
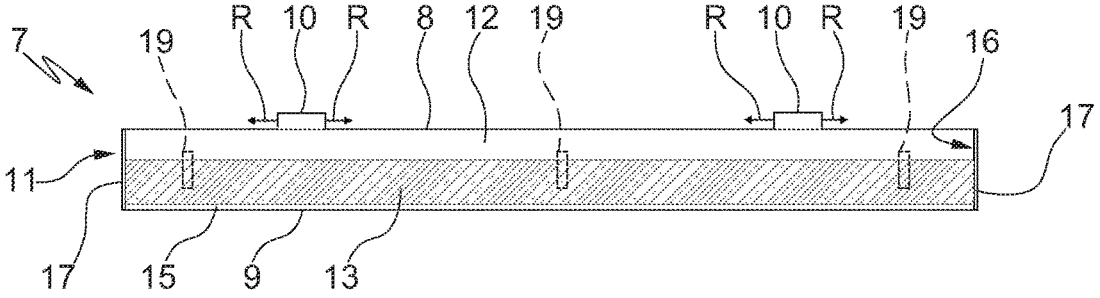
FIG. 13 is a sectional view along the plane XIII-XIII of the component of a protective helmet pursuant to FIG. 12.

According to a further version of the present invention, the at least one pad 7 can comprise further dissipation means 19 (FIG. 13).

The further dissipation means 19 can be positioned in a different manner with respect to that previously described relative to the dissipation means 17.

By way of example, if the at least one layer deformable by shearing 12 of the at least one pad 7 has a wide planar extension, the further dissipation means 19 can be provided positioned within the planar size of the at least one first surface 8. Illustrated in FIG. 13, by way of a non-limiting example, is a possible arrangement and configuration of the further dissipation means 19. It is intended that the further dissipation means 19 can be configured or positioned inside the at least one pad 7 in a different manner without departing from the protective scope of the present invention.

The further dissipation means 19 can be extended through at least one portion of the at least one pad 7 comprised between the first surface 8 and the second surface 9.

With reference to the version of the at least one pad 7 comprising at least one layer deformable by shearing 12 and at least one further layer 13, the further dissipation means 19 can be extended at least partially through the at least one layer deformable by shearing 12 and the at least one further layer 13 and thus act as a connection element for the same.

The further dissipation means 19 are configured for collaborating with the at least one layer deformable by shearing 12 in a manner such to dissipate the greatest quantity of energy of the components R, L of forces F acting on the protective helmet 1.

For example, the further dissipation means 19 can be provided for determining a variable resistance progressive with the relative movement between the connecting means 10 and the second surface 9 along specific directions.

The protective helmet 1 can comprise constraining means, belts or the like, for its connection to the head of a user. Such constraining means ensure a firm connection of the protective helmet 1 to the user's head in order to prevent, in case of collision, the protective helmet 1 from coming off the head itself. Such constraining means are not illustrated in the enclosed figures since they do not form an object of the present invention.

Figure 1:
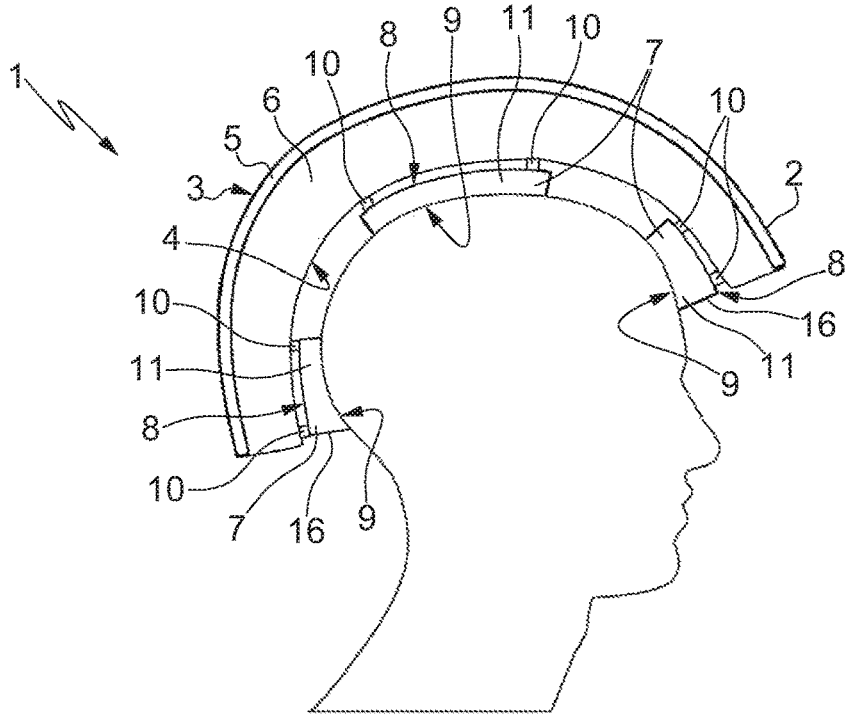
FIG. 1 is a schematic side view in section of a protective helmet according to the present invention, worn on the head of a user.

With reference to the embodiment illustrated in the FIGS. 1 and 2, the protective helmet 1 can comprise at least three pads 7 respectively arranged at the frontal portion, the central portion and rear portion of the protective helmet 1 in order to respectively abut against the frontal portion, parietal portion and occipital portion of the head of a user during use.

Nevertheless, possible further configurations of the protective helmet 1 are possible, comprising a greater or lesser number of pads 7, possibly positioned in a different manner, with respect to that described above or illustrated in the enclosed figures, without departing from the protective scope of the present invention.

By way of example, according to a further version of the present invention, not illustrated in the enclosed figures, the protective helmet 1 can comprise pads 7 positioned at the lateral portions of the protective helmet 1 itself in order to abut against the temporal portion of the head of a user during use.

The planar shape of the at least one pad 7 can vary as a function of specific use requirements.

According to one version of the present invention, the at least one pad 7 can have an elongated and narrow shape, for example in order to abut against the occipital portion and one or both temporal portions of the user's head during use. In addition, if the at least one pad 7 is provided for abutting against the parietal portion of the head of a user, it can have tapered portions which protrude from a central portion, according to the illustrated embodiment, by way of example, in the enclosed FIGS. 12 and 14.

It is intended that the at least one pad 7 can be shaped in a different manner than that illustrated in the enclosed figures, without any limitation.

By way of example, a protective helmet 1 can comprise multiple pads 7 comprising, in turn, the same number of layers 12, 13, 14, 15.

Further configurations of the present invention are possible, in which the protective helmet 1 comprises one or more pads 7 with a different number of layers 12, 13, 14, 15 with respect to those present in the remaining pads 7 provided in the same protective helmet 1, as a function of specific use requirements.

According to one aspect of the present invention, the inner surface 4 of the shell 2 around the area occupied by the at least one pad 7 lacks obstacles, protuberances or further pads 7 that can interfere with the deformation and with the mobility of the at least one pad 7, reducing the effectiveness thereof.

The operation of the protective helmet 1 according to the present invention is now reported in brief.

With the protective helmet firmly worn on the head of a user, the at least one pad 7 is firmly in contact against the head itself, in order to prevent sliding or relative movements between the second surface 9 of the at least one pad 7 and the head of the user.

Following an impact, linear components L and rotational components R are transmitted to the shell 2 of the protective helmet 1.

The rotational components R tend to make the shell 2 rotate with respect to the head of a user and, due to the connecting means 10, cause the deformation of the at least one pad 7 or more generally of the at least one layer deformable by shearing 12 associated therewith. Such deformation occurs through the sliding and/or relative rotation between at least one portion of the first surface 8 and the second surface 9 of the at least one pad 7 with respect to the shell 2.

During the deformation of the at least one pad 7, part of the energy of the rotational components R is dissipated due to the deformation of the at least one layer deformable by shearing 12, reducing the rotational effects acting on the head of a user.

As stated, the second surface 9, in use, is firmly constrained to the head of a user, while the at least one first surface 8 is constrained to the shell 2. The second surface 9 can be moved with respect to the shell 2 and, consequently, the shell 2 can be moved with respect to the head of the user, reducing the shaking to which the brain of a user in an impact is subjected.

If the protective helmet 1 comprises dissipation means 17, 19, the same allow reducing and absorbing part of the energy of the rotational components R through its deformation.

The dissipation means 17, 19, synergistically with the at least one layer deformable by shearing 12, contribute to reducing the size of the rotational accelerations to which the head of a user in an impact is subjected.

The at least one pad 7 can be elastic or viscoelastic, in order to return to its original configuration as soon as the stress of an impact ceases.

The at least one pad 7 thus configured is therefore capable of absorbing the stresses of a further impact, without having to be substituted.

Possibly, if the dissipation means 17, 19 are elastic or viscoelastic, they attain same advantages described above with regard to the at least one pad 7.

As stated, the at least one pad 7 has a limited thickness with respect to its planar extension. Therefore, given the same cranial circumference of a user, a protective helmet 1 according to the present invention can have the same size as a protective helmet of conventional type.

In addition, the at least one pad 7 has an overall weight substantially equal to or of the same order of magnitude as that of the padding pads of the helmets of conventional type.

According to one aspect of the present invention, the connecting means 10 and/or the at least one layer deformable by shearing 12 allow the rotation of the at least one pad 7, or of at least one portion thereof, with respect to the shell 2 around the point or the single points of connection between the at least one pad 7 and the shell 2, determined by the connecting means 10 themselves. In such a manner, the effects of the circumferential/rotational stresses R that act on the head of a user following an impact can be effectively reduced or even completely canceled, benefiting the user with a high safety of use.

A further embodiment of a protective helmet according to the present invention is illustrated in detail in the enclosed FIGS. 20 to 23 and is indicated overall with the reference number 100.

In the following description, the same previously-described elements will be indicated with the respective reference numbers plus 100 units.

The protective helmet 100 can have the same characteristics described for the preceding embodiment—which therefore are considered as referred to herein—differing from the latter with regard to the possibility to associate the at least one layer deformable by shearing 112 in a removable manner with the at least one pad 107.

The protective helmet 100 comprises a shell 102 provided with an outer surface 103 and an inner surface 104 opposite each other and distal, and at least one pad 107 associable with the shell 102 through connecting means 110.

The at least one pad 107 is configured as a substantially laminar body 111 and has at least one first surface 108, in use proximal to the shell 102, and a second surface 109 distal from the shell 102 and adapted to abut against the head of a user in use.

The protective helmet 100 comprises at least one layer deformable by shearing 112 associable with the at least one pad 107.

More in detail, the at least one layer deformable by shearing 112 is provided interposed between the connecting means 110 and the at least one pad 107.

According to such version, the at least one pad 107 can comprise a further layer 113, analogous to that described for the preceding embodiment.

The layer of material deformable by shearing 112 can be configured as a membrane 118.

Figure 20:
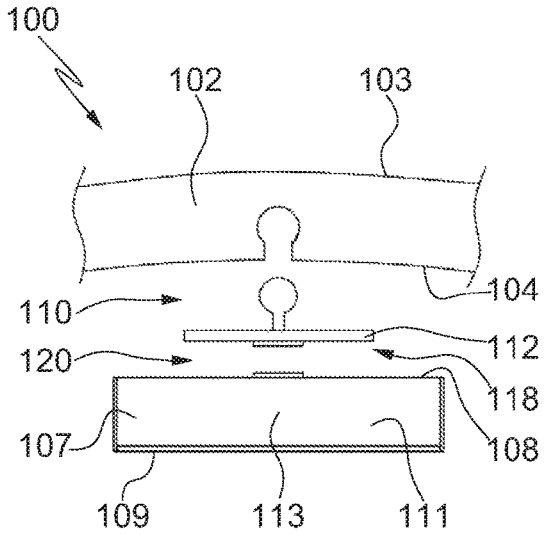
FIGS. 20 to 23 are detailed schematic views of further embodiments of a protective helmet according to the present invention.

According to one version of the present invention, the connecting means 110 are configured for ensuring a connection of removable type between the at least one layer deformable by shearing 112, and hence between the at least one pad 107 and the shell 102, according to the above-described modes (see FIG. 20).

According to one version of the present invention, the connecting means 110 are configured for ensuring a connection of removable type and comprise at least one element of the type with Velcro® fasteners, or automatic buttons and similar means suitable for such purpose between the at least one layer deformable by shearing 112, and hence between the at least one pad 107 and the shell 102, according to the above-described modes.

Figure 21:
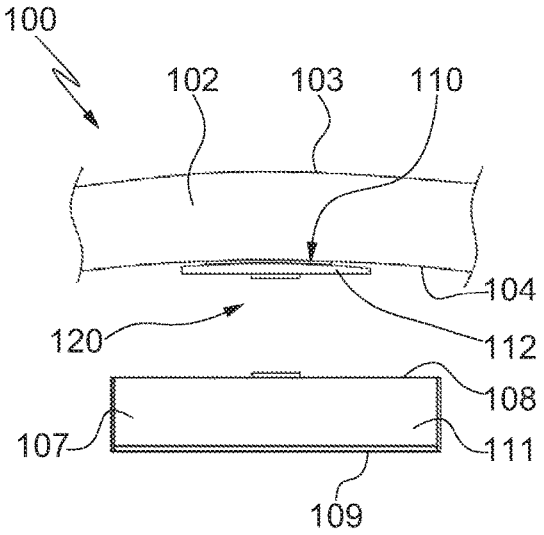

According to a further version of the present invention, the connecting means 110 are configured for ensuring a connection of permanent type between the at least one layer deformable by shearing 112 and the shell 102, and hence between the at least one pad 107 and the shell 102 according to the above-described modes, such as gluing, chemical/mechanical constraint etcetera (see FIG. 21).

According to a further version of the present invention, the protective helmet 100 can comprise further means 120 for the removable connection between the at least one layer deformable by shearing 112 and the at least one pad 107 (FIGS. 20-23).

The further connecting means 120 can comprise at least one male element associated with one between the at least one layer deformable by shearing 112 and the at least one pad 107, and at least one female element associated with the other between the at least one pad 107 and the at least one layer deformable by shearing 112, in which the male element and the female element are mutually connectable, in a removable manner, through shape coupling.

According to one version of the present invention, the further connecting means 120 can be of the type with Velcro® fasteners, or automatic buttons or similar means suitable for such purpose.

If it is necessary to remove the at least one pad 107 from the shell 102, for example in order to execute the cleaning or substitution thereof, it is sufficient to act on the further connecting means 120.

If the protective helmet 100 comprises connecting means 110 of removable type, it is possible to remove from the shell 102 also the at least one layer deformable by shearing 112, in order to be able to execute the maintenance or possibly the substitution thereof.

Figure 22:
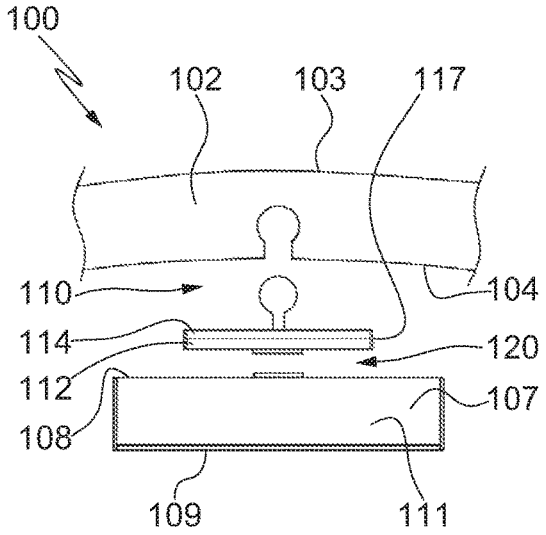
Figure 23:
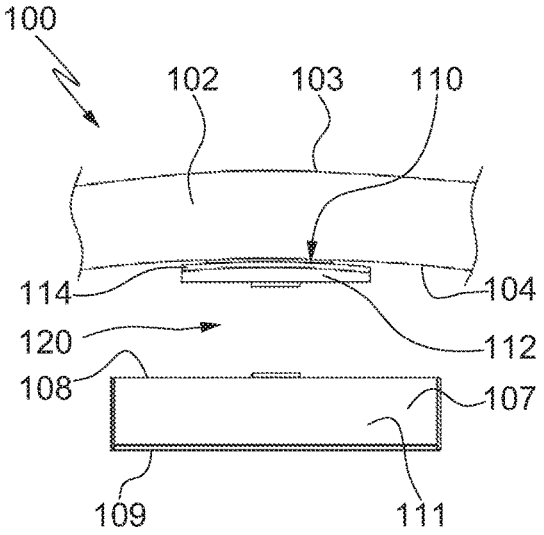

According to a further embodiment illustrated in the enclosed FIGS. 22 and 23, the protective helmet 100 can comprise at least one inner layer 114 with low friction coefficient provided in a position interposed between the connecting means 110 and the at least one layer deformable by shearing 112.

The inner layer 114, analogous to the preceding embodiment, facilitates the mobility of the at least one layer deformable by shearing 112 with respect to the shell 102, preventing jamming from occurring that is such to compromise the capacity of the helmet 100 to damp rotational components R and circumferential components L of the forces F generated against the helmet 100 itself following a collision.

The inner layer 114 and the at least one layer deformable by shearing 112 are mutually connected according to the previously described modes.

Figure 24:
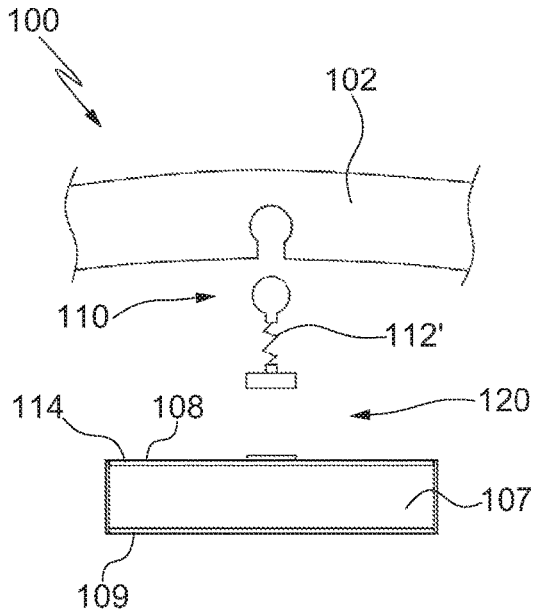
FIGS. 24-27 are schematic views of a detail of further embodiments of a protective helmet according to the present invention.
Figure 25:
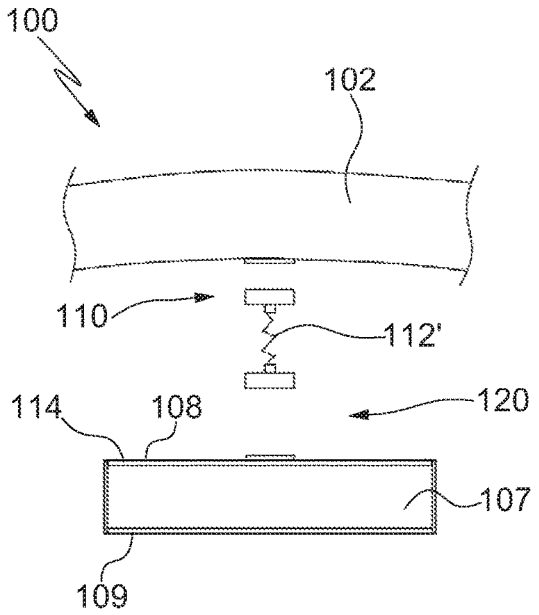

Further versions of the preceding embodiment of the protective helmet 100 are illustrated in detail in the enclosed FIGS. 24 and 25, in which the at least one element deformable by shearing 112' is represented through a jagged or zigzag line.

Analogous to that described above, the at least one layer deformable by shearing 112' can be associated with the shell 102 through the connecting means 110 and with the at least one pad 107 through the further connecting means 120. More precisely, the at least one layer deformable by shearing 112' can be made integral with the connecting means 110 and with the further connecting means 120, in a position interposed between the same.

The at least one element deformable by shearing 112' can be made of elastomer material, attaining the same aims described above with regard to mobility, intended as translation and/or rotation, of the at least one pad 107 at the point or points of connection to the shell 2.

Figure 26:
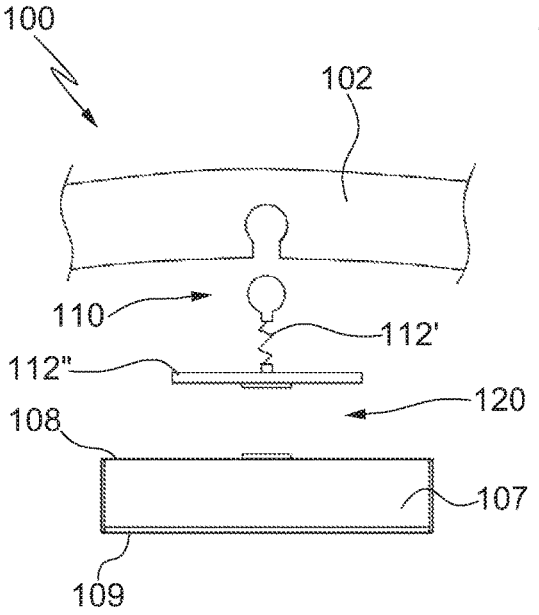

According to a further version of the present invention illustrated in FIG. 26, the protective helmet 100 can comprise at least one layer deformable by shearing 112' and at least one further layer deformable by shearing 112" operatively associable with the shell 102 and with the at least one pad 107.

More in detail, the at least one layer deformable by shearing 112' and the at least one further layer deformable by shearing 112" can be connected in succession with each other—connection in series. The at least one layer deformable by shearing 112' can be associated in a removable or permanent manner to the shell 102 through the connecting means 110, according to the modes described above.

The at least one further layer deformable by shearing 112", instead, can be associated with the at least one pad 107 in permanent or removable manner through the further connecting means 120, according to the same above-described modes.

The at least one layer deformable by shearing 112' and the at least one further layer deformable by shearing 112" can have the same or different mechanical properties (yieldability, elasticity), as well as an identical or different structure.

A protective helmet 100 comprising the at least one layer deformable by shearing 112' and the at least one further layer deformable by shearing 112" has an increased possibility to differentiate the elastic yieldability and hence the mobility of the single points of connection between the at least one pad 107 and the shell 102, allowing an increased possibility to personalize the capacity of the protective helmet 100 itself to damp or completely cancel the effects of a collision as a function of specific use requirements.

According to one version of the present invention, the at least one layer deformable by shearing 112 and the inner layer 114 can be mutually connected through retention means 117.

According to a further version of the present invention, not illustrated in the enclosed figures, the at least one layer deformable by shearing 12, 112 can comprise two semi-rigid elements mutually connected through elastic connections, in a manner such to be able to mutually rotate and/or translate, attaining the same above-described advantages.

Figure 27:
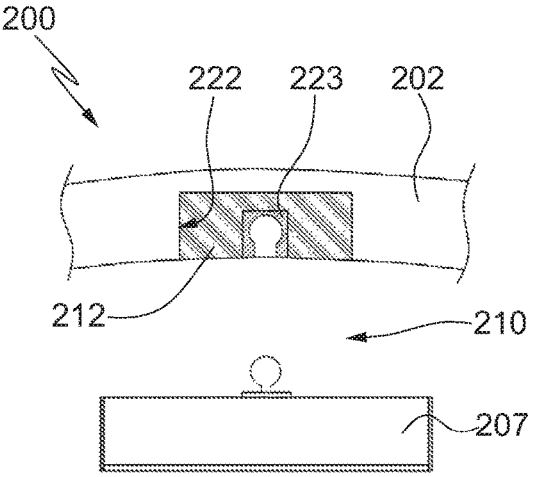

According to a further version of the present invention, illustrated by way of example in the detailed view of FIG. 27, the protective helmet 200 can comprise at least one layer deformable by shearing 212 at least partially incorporated in the shell 202.

Analogous to the preceding versions, connecting means 210 are provided for the connection between the at least one layer of material deformable by shearing 212 and the at least one pad 207.

The shell 202 comprises at least one housing 222, within which at least one layer of material deformable by shearing 212 is at least partially housed.

By way of example, the at least one layer of material deformable by shearing can be made in the shell 202 during the forming of the shell 202, through co-molding or, possibly, integrated in the housing 222 following the forming of the shell 202.

The connecting means 210 can be of removable type or of permanent type. If the connecting means 210 are of removable type, the same can comprise Velcro® means or the like or comprise at least one male element associable with at least one corresponding female element. In such case, the at least one layer deformable by shearing 212 can have an auxiliary portion 223 made of a more rigid material than that of the at least one layer deformable by shearing 212, in which the male element or the female element of the connecting means 210 is supplied. In practice, the auxiliary portion 223 acts as a stable support for the male element or female element of the connecting means 210 within the at least one layer deformable by shearing 212.

With reference to that described, it is intended that a protective helmet according to the present invention can comprise one or more versions of the connecting means 10, 110, 210 and/or of the at least one layer deformable by shearing 12, 112, 112', 112", 212, without any limitation. In practice, if the protective helmet comprises two or more pads 7, 107, 207, the connecting means 10, 110, 210 along with the type of layer deformable by shearing 12, 112, 112', 212 can be the same for each pad or different from each other, still attaining the objects of the present invention.

The protective helmet 1, 100, 200 according to the present invention is configured for allowing the relative movement, sliding and/or rotation, between the shell 2, 102, 202 and the head of a user who wears it substantially along any direction.

The point configuration of the connection determined by the connecting means 10, 110, 210 and if present by the further connecting means 120 allows the translation and/or the rotation between the single portions of the at least one pad 7, 107, 207 which are associated with the shell 2, 102, 202 through the connecting means 10, 110, 210 and if present also through the further connecting means 120, themselves. The single points of connection can then be moved independently from each other, thus allowing an articulated movement of the single portions of the at least one pad 7, 107, 207 which are associated with the shell 2, 102, 202. Therefore, the entire at least one pad 7, 107, 207 or only some portions thereof can be moved with respect to the shell 2, 102, 202 with an articulated and complex motion substantially along any direction. More in detail, the mobility of the at least one pad 7, 107, 207 varies as a function of the number and arrangement of the connecting means 10, 110, 210 which, as described, determine single points of connection, elastically yieldable in an independent manner from each other, between the at least one pad 7, 107, 207 and the shell 2, 102, 202. With respect to the solutions of known type, the protective helmet 1, 100, 200 according to the present invention is capable of ensuring a high protection to the head of a user, independent of the direction along which the collision occurs, since it does not have preferred directions along which the linear component and/or rotational component released following an impact are to be absorbed.

In addition, contrary to the solutions of known type, only the portion of the at least one pad 7, 107, 207 affected by the stresses acting on the protective helmet 1, 100, 200 can be deformed and/or moved, thus also allowing the isolation of the parts of the head of a user that are distal from the zone close to where the impact occurs.

As is known, the human skull does not have a spherical shape but rather a complex geometry. It is in fact observed that in plan view, the base of the skull has a substantially oval shape, while in side view, along a so-called sagittal plane that identifies a right and left portion of the skull, the latter has a round shape in which the single frontal, temporal, parietal and occipital portions each have sections with different curvature radii.

A shell of a protective helmet of conventional type can be internally shaped complementary to the head of a user, and thus allow a mobility, even if limited, between the protective helmet itself and the skull only along several main directions.

Analogous considerations hold true for a protective helmet which has an outer shell internally associated, in a rotating manner, with a shell or a padding complementary to the head of a user, since such mutual mobility does not allow effectively dissipating the stresses released following an impact, and facilitates the mobility between the outer shell and the inner shell only along some main directions.

In the case of an impact which acts along directions that are different from the aforesaid main direction, a helmet thus configured ensures poor protection against the rotational accelerations transmitted to the head of a user.

The protective helmet 1, 100, 200 according to the present invention is capable of effectively reducing the effects of a collision acting against the shell 2, 102, 202 substantially along any direction.

In practice, the protective helmet 1, 100, 200 is capable of reducing, with the same effectiveness, the effects of an impact against the shell 2, 102, 202 independent of the direction along which the collision occurs.

The protective helmet 1, 100, 200 according to the present invention does not have a preferred main direction for absorbing a collision but it is capable of effectively reducing the effects of a collision independent of the action direction thereof.

In the protective helmet 1, 100, 200, the single connecting means 10, 110, 210 and possibly the further connecting means 120, if provided, act as movable sliders, independent from each other.

The shell 2, 102, 202 can therefore be moved with an articulated and complex rotational motion of sliding/rotation with respect to the head of a user substantially along any direction.

Indeed, the single connecting means 10, 110, 210 can be moved for sliding and/or rotation with respect to the at least one pad 7, 107, 207 independently from each other and thus allow a high mobility of the shell 2, 102, 202 with respect to the head of a user.

In fact, in the protective helmet 1, 100, 200 according to the present invention, the single pads 7, 107, 207 are associated with shell 2, 102, 202 independently from each other through at least one point of connection, around which they can translate and/or rotate along any direction.

From that set forth above, it is perceived that the protective helmet 1, 100, 200 according to the present invention is capable of attaining the set objects.

In particular, the protective helmet 1, 100, 200 has a structure that is easy to make with limited production costs, so as to be able to promote and facilitate the manufacturing thereof.

In addition, the protective helmet 1, 100, 200 according to the present invention allows obtaining a protective device adapted to reduce the effects of the rotational stresses, in case of impact, in the scope of a solution with reduced weight, given the same cranial circumference of a user—and hence size—of the protective helmet 1, 100, 200.

As appears evident, the reduction and limiting of the overall weight of the protective helmet 1, 100, 200 facilitates higher safety thereof, allowing the reduction of the mass associated with the head of a user and, consequently, the overall energy quantity to be dissipated in case of impact.

According to a further aspect of the present invention, the at least one pad 7, 107, 207 can be used in a helmet of conventional type, which has a shell with one or more padding pads constrained at its interior. For example, the pad 7, 107, 207 can be substituted for the padding pads present in such helmet of conventional type, in order to allow the reduction of the rotational stresses transmitted to the head of a user in an impact.

The above-described protective helmet 1, 100, 200 is susceptible of numerous modifications and variants within the protective scope of the following claims.

The invention claimed is:

1. A protective helmet comprising a shell provided with an outer surface and an inner surface, at least one pad which protrudes from said inner surface towards the inside of said protective helmet on the side opposite said outer surface, said at least one pad having at least one first surface, in use proximal to said inner surface, one second surface in use distal from said inner surface, said second surface being configured in use for firm abutment against said head of a user, said protective helmet comprising means for the connection of said at least one pad to said shell, wherein said means for the connection are associated or associable with said at least one first surface wherein at least one pad is configured as a laminar body and comprises at least one layer deformable by shearing in response to the forces acting on said shell following an impact, wherein said at least one layer deformable by shearing is in turn associated or associable with said shell, so as to allow the sliding and/or the relative rotation of said shell with respect to said second surface and to dissipate through its deformation at least part of the energy associated with circumferential/rotational components of said forces.

2. The protective helmet according to claim 1, wherein said at least one layer deformable by shearing is configured as a membrane.

3. The protective helmet according to claim 1, wherein said at least one pad comprises at least one further layer associable, by superimposition, with said at least one layer deformable by shearing.

4. The protective helmet according to claim 3, wherein at least one of said at least one layer deformable by shearing and said at least one further layer is elastically, viscoelastically, viscoplastically or elastoplastically deformable or deformable at least by shearing, for dissipating, through its deformation, the energy associated with said circumferential/rotational components acting on said at least one pad.

5. The protective helmet according to claim 1, comprising at least one inner layer associable with at least one of said at least one pad and with said at least one further layer, in order to facilitate at least one of the sliding of at least one portion of said at least one pad with respect to said connection means and the relative sliding between said at least one layer deformable by shearing and said at least one further layer.

6. The protective helmet according to claim 1, comprising dissipation means associated at least with said at least one layer deformable by shearing, configured for dissipating, through their deformation, at least part of the energy of said circumferential component of said forces acting against said shell, wherein said dissipation means are tape or strip shaped or are stitching or welding or heat-sealing.

7. The protective helmet according to claim 6, wherein said dissipation means are operatively associated with said means for the connection.

8. The protective helmet according to claim 1, wherein said at least one pad comprises further dissipation means associated at least with said at least one layer deformable by shearing.

9. The protective helmet according to claim 1, comprising further connecting means for the connection of removable type between said at least one layer deformable by shearing and said at least one pad.

10. The protective helmet according to claim 9, wherein said inner layer is associated with said connecting means, in a position interposed between said at least one layer deformable by shearing and said connecting means.

11. The protective helmet according to claim 1, wherein said layer deformable by shearing is made of elastomeric material.

12. The protective helmet according to claim 1, comprising a further layer deformable by shearing constrained in series to said at least one layer deformable by shearing.

13. The protective helmet according to claim 1, wherein said shell comprises at least one housing within which at least one layer of material deformable by shearing is at least partially housed.

14. A pad associable with the inside of a protective helmet through connecting means, said pad being shaped as a substantially laminar body and comprising at least one first surface and a second surface that are opposite each other, wherein said substantially laminar body comprises at least one layer deformable at least by shearing and configured so as to allow the sliding and/or the relative rotation between said at least one first surface and said second surface following the action of shear stresses acting on said at least one first surface and/or on said second surface.

15. The pad according to claim 14, comprising at least one inner layer with low friction coefficient.

16. The pad according to claim 14, wherein said at least one layer deformable at least by shearing is configured as a membrane.

17. A protective helmet comprising:

a shell provided with an outer surface and an inner surface;

at least one pad which protrudes from said inner surface towards the inside of said protective helmet on a side opposite said outer surface, said at least one pad having at least one first surface, in use proximal to said inner surface, one second surface in use distal from said inner surface, said second surface being configured in use for firm abutment against said head of a user, said protective helmet further comprising at least one layer deformable by shearing;

means for the connection of said at least one layer deformable by shearing to said shell, wherein at least one pad is configured as a laminar body and is associable with at least said one layer deformable by shearing in response to forces acting on said shell following an impact by means of further means for connection, wherein said at least one layer deformable by shearing is configured so as to allow at least one of sliding and relative rotation of said shell with respect to said second surface and to dissipate through deformation of said at least one layer deformable by shearing at least part of the energy associated with at least one of circumferential and rotational components of said forces.

* * * * *